United States Patent [19]

Boedecker et al.

[11] Patent Number: 4,735,228

[45] Date of Patent: Apr. 5, 1988

[54] DEVICE FOR DISPERSING SOLID DETERGENTS AS AQUEOUS SUSPENSIONS OR SOLUTIONS

[75] Inventors: Kay Boedecker, Chieming; Robert Scheurl, Inzell; Hans-Erwin Strasser, Siegsdorf, all of Fed. Rep. of Germany

[73] Assignee: Lang Apparatebau GmbH, Siegsdorf/Obb., Fed. Rep. of Germany

[21] Appl. No.: 65,237

[22] Filed: Jun. 22, 1987

[30] Foreign Application Priority Data

Jun. 21, 1986 [DE] Fed. Rep. of Germany ..... 3620900

[51] Int. Cl.[4] ..... B01F 1/00

[52] U.S. Cl. ..... 137/268; 422/261

[58] Field of Search ..... 137/268; 422/261, 263, 422/274, 278

[56] References Cited

U.S. PATENT DOCUMENTS 3,094,134 6/1983 Currie ..... 137/268 X
3,912,627 10/1975 Tepas ..... 137/268 X
3,915,191 10/1975 Eisenthal ..... 137/268
3,999,750 12/1976 Perkins ..... 137/268 X
4,208,376 6/1980 Sangster ..... 137/268 X

FOREIGN PATENT DOCUMENTS 0058507 2/1982 European Pat. Off. .
2656413 6/1977 Fed. Rep. of Germany .
8405194 4/1984 Fed. Rep. of Germany .

*Primary Examiner*—Alan Cohan
*Attorney, Agent, or Firm*—Ernest G. Szoke; Henry E. Millson, Jr.; Mark A. Greenfield

[57] ABSTRACT

A device for the preparation of a suspension from a supply of powdered, granular or block-form detergent by spraying water through nozzles into a water-permeable container accommodating the detergent material, provided with a hinged cover, at least one biasing means which pivots the sieve-like container as the cover opens from its horizontal in-use position toward the inside of the front wall of the housing, which is inclined outward in relation to the vertical housing axis, and at least one closure element which is arranged on the pivotal cover and which, as the cover pivots into its closed position, engages the container and turns it against the force of the biasing means into its horizontal in-use position, keeping it in that position.

20 Claims, 7 Drawing Sheets

DEVICE FOR DISPERSING SOLID DETERGENTS AS AQUEOUS SUSPENSIONS OR SOLUTIONS

BACKGROUND OF THE INVENTION

1. Field of the Invention

This invention relates to a device for the preparation and dispersion of a suspension or solution from a supply of powdered, granular or block-form detergent. The device operates by spraying water through nozzles into a container accommodating the supply of detergent and is provided with a hinged cover for the measured addition of a detergent. It is especially suitable for institutional dishwashing machines.

2. Statement of Related Art

Devices for the preparation of a suspension from a supply of detergent for the measured addition of detergent to institutional dishwashing machines are already known, particularly for blockform detergents. However, these known devices are adapted to certain detergent block dimensions and therefore are not suitable for the use of powdered or granular detergents. Powdered detergent cannot effectively be dissolved in measured quantities in devices of this type and clumps therein. Accordingly, it is still common practice today to add powder detergents to small and medium-size dishwashing machines manually, for example by pouring in powder directly from the pack. As a result, the frequently harsh detergent cannot always be prevented from coming into contact with the skin. In addition, residues of suspension still present in the device are in danger of splashing out when the device is refilled with detergent material.

To avoid this risk, block-form detergent material for dishwashing machines is cast, for example, in cartridges which are relatively expensive to make.

SUMMARY OF THE INVENTION

Other than in the operating examples, or where otherwise indicated, all numbers expressing quantities of ingredients or reaction conditions used herein are to be understood as modified in all instances by the term "about".

The present invention provides for simple and convenient handling of the detergent during filling and for effective and safe dissolution and/or suspension, and flushing out of the detergent.

This is achieved in accordance with the invention by: a sieve-like (water permeable) container accommodating the detergent material; at least one biasing means which pivots the container on its forward, lower, lateral edge (as the cover opens from its horizontal in-use position), toward the inside of the front wall of the housing, which front wall is upwardly inclined outward at an angle Y of 10° to 20°, preferably 15°, in relation to the vertical housing axis; and at least one closure means which is arranged on the pivotal cover and which, as the cover pivots into its closed position, engages the container, and overcomes the force of the biasing means, pivoting the container into its horizontal in-use position (i.e., with a generally vertical attitude), keeping it in that position. The front of the housing is preferably contoured so that only about that portion of the front wall adjacent the container is inclined, the remaining front wall being vertical.

Because the container accommodating the detergent tilts toward the user as the cover pivots open and tilts back when it closes, the device according to the invention provides for simple and convenient filling with a powder, granular or block detergent.

In one advantageous and particularly practical embodiment of the invention, two closure elements are provided, having substantially nose-like cross-section which, as the cover pivots into the closed position, engage lateral flanges formed integrally with the sieve-like container and, in the closed position, rest on the lateral flanges with at least part of their edge surface remote from the cover, thus holding the container in a generally vertical attitude. On the one hand, this special design provides for problem-free pivoting of the cover and the container. On the other hand, it contributes towards safeguarding the cover against unintentional opening because, since the edge surfaces remote from the cover rest on the lateral flanges, the tips of the closure elements initially slide with friction along the side flanges during the opening process before they are lifted by the pivoting movement of the cover. The friction generated counteracts and stabilizes the opening movement of the cover.

In another embodiment of the invention, the cover comprises a step and substantially two thirds of the width of the upper side of the housing is comprised by the cover and substantially one fifth the height of the front wall of the housing is comprised by the cover and step. This ensures that, when the cover is open, a sufficiently large opening is formed for convenient filling of the device with detergent material.

In another embodiment of the invention spray means comprising at least one, preferably two injection nozzles forward directed onto the detergent material and inclined at an angle X of from 5° to 10°, preferably 8°, relative to the vertical axis of the housing are provided above the detergent material in that inner region of the upper wall of the housing which is not formed by the cover, to afford spraying means. This arrangement of the injection nozzles on the one hand provides for optimal dissolution and flushing out of the detergent material and, on the other hand, prevents the nozzles from pivoting with the cover when it is opened. This prevents a possibly hot jet of water being directed onto the user on opening of the cover in the event of failure of the water supply control.

In another embodiment of the invention, the device comprises a liquid level governor arranged in the region of the device outlet opening, the governor having a lower opening at the base of the housing and an upper opening substantially level with the maximum filling level of the detergent material. This prevents liquid from overflowing from the device.

To prevent product deposits and residues of suspension from remaining at the bottom of the housing, a further embodiment of the invention is characterized in that the base of the housing slopes downward toward the outlet opening from at least three sides of the housing at an angle of 5° to 15° relative to the horizontal plane of the container when it is in place and the container is arranged above this region of the base of the housing. Where the outlet is immediately below a corner of the housing interior, it may be possible to slope on only one or two surfaces. Alternatively, a curved, truncated, funnel surface may be adequate. This prevents any residue of suspension or solution, into which the bottom of the container dips, from remaining in the device so that there is no liquid to splash out when the container is filled with detergent material.

A sieve-like container having a mesh width of 0.25 mm is of advantage for filling the device with standard powder-form detergent material. This mesh width on the one hand prevents too much powder material from trickling through the container during filling, which would impede the preparation of a uniform suspension, and on the other hand guarantees sufficiently large water throughflow openings to permit spraying from the nozzle at a high rate.

Where granular detergent material of conventional size is used, it is best for the reasons explained above to provide round holes 0.6 to 0.8 mm in diameter.

Accordingly, another embodiment of the invention is characterized by a sieve-like container having a mesh width of 0.25 mm or round holes 0.6 to 0.8 mm in diameter.

To shut off the supply of water when the cover is open, a further embodiment of the invention is characterized by the presence of communication means within the housing, for communicating when the cover is closed to a water shut-off device, also disposed within the housing, operatively connected to the inlet or between the inlet and the spray means, such communication means comprising an element, more especially a magnet and Hall-effect switch, which is arranged on the housing at the edge of the cover opening and which projects into the interior of the housing or into a chamber for communicating the closed position of the cover to a device which influences the supply of water.

Finally, another embodiment of the device according to the invention is distinguished by a compartment formed in the housing to accommodate a computer means comprising a printed-circuit board equipped with electronic components which influences the supply of water by an operative connection to a flow rate means disposed within the housing and operatively connected to the inlet means or between the inlet and the spray means, and which is operatively connected to a conductivity measuring means. The conductivity measuring means, whose individual components are conventional, meters the water supply to maintain a given detergent solution/suspension concentration, based upon variations in conductivity caused by differing concentrations of a prepared solution or suspension.

BRIEF DESCRIPTION OF THE DRAWING

The invention is described by way of example in the following with reference to the accompanying drawing, wherein:

FIGS. 1 through 8 illustrate a preferred embodiment of this invention. The various elements identified in FIGS. 9 through 12 correspond exactly to those elements visible in FIGS. 1 through 8. It may be noted that FIGS. 4, 5, and 8 are taller than described in the specification and as shown in other Figures, merely for purposes of illustration.

DETAILED DESCRIPTION OF THE INVENTION

Figure 11:
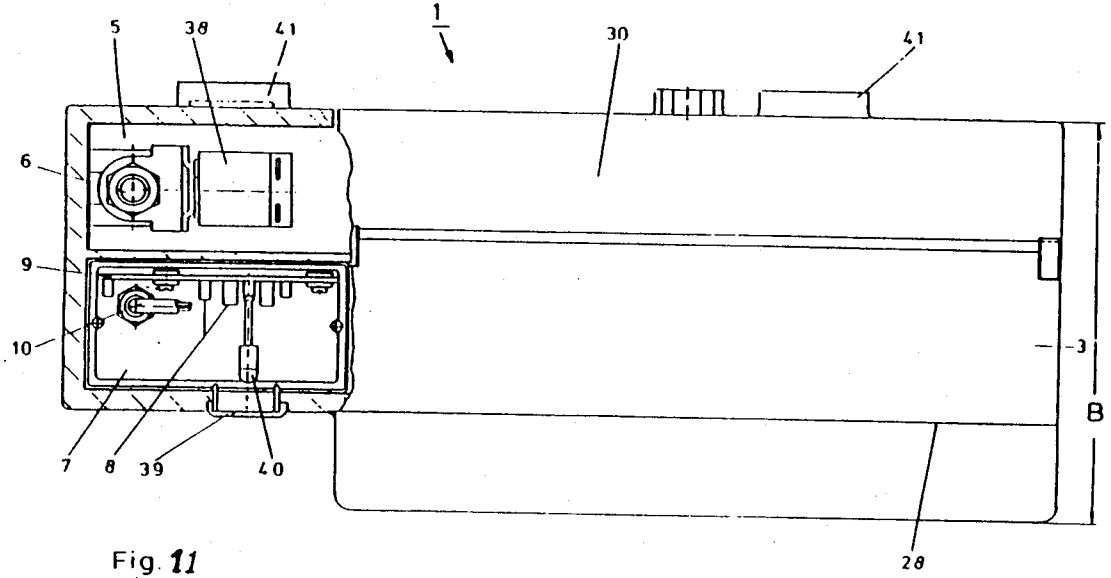
FIG. 11 is a top plan view of a device according to the invention partly in section.
Figure 12:
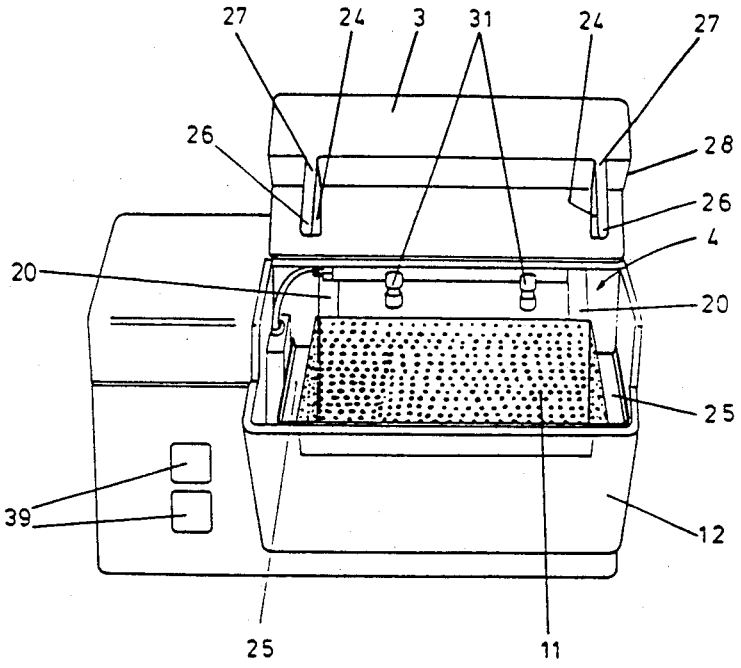
FIG. 12 is a perspective view with the cover open.

The device globally denoted by the reference 1 comprises a housing 2 with a hinged cover 3. The housing 2 and the cover 3 enclose an interior 4 of the housing for the preparation of a suspension. In addition, the housing 2 is formed with a water compartment 5 for the water supply 6 and a control compartment 7 for accommodating a printed circuit board 9 equipped with electronic components 8 and a lead-in wire 10 (FIG. 11).

Figure 9:
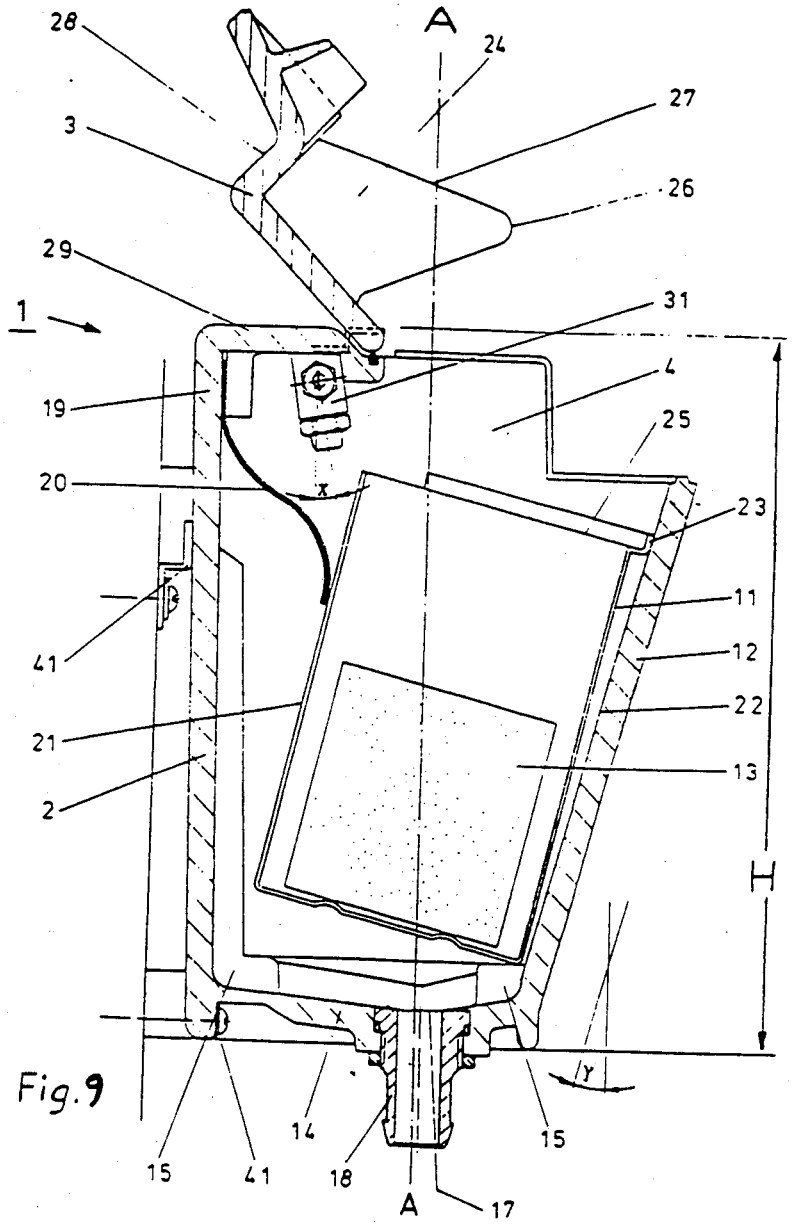
FIG. 9 is a side elevation of a device according to the invention in section taken through the outlet and perpendicular to the housing back wall.
Figure 10:
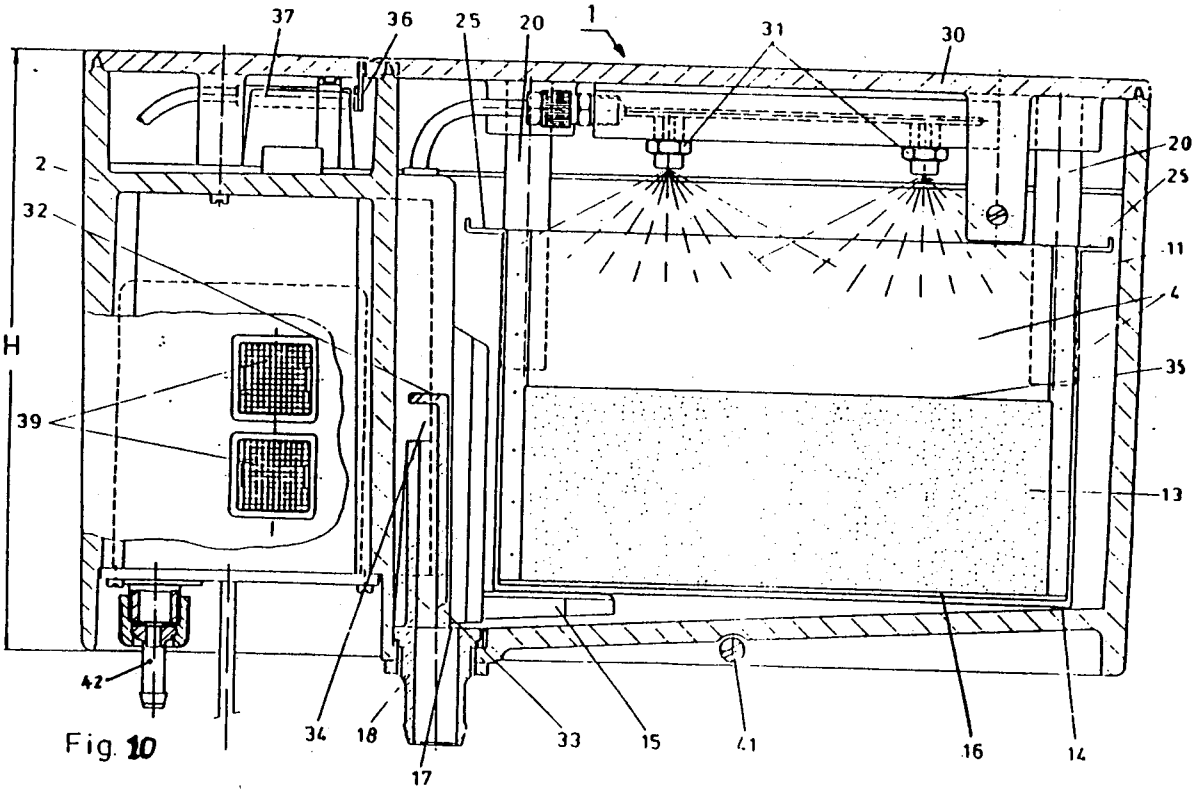
FIG. 10 is a front elevation of a device according to the invention substantially in section.

Arranged in the interior 4 of the housing is a removable sieve-like container 11 which is designed to tilt towards the front wall 12 of the housing 2. The sieve-like container 11 is open on the side facing the removal opening of the housing 2 designed to be closed by the cover 3, (generally its top) whereas its remaining side walls are formed by a sieve (not shown) having a mesh width of, typcially, 0.25 mm. In the example illustrated, in FIGS. 9, 10, container 11 is filled with a detergent block 13. At its bottom 16, the container 11 rests on the base 14 of the housing interior 4 and on a plurality of rests 15. The rests 15 are aligned with one another in such a way that, in use, the bottom 16 of container 11 extends horizontally. The bottom 16 of the container 11 as shown is substantially flat, although it may be corrugated. In the example illustrated, the container 11 is made of stainless steel although it may also be made of a plastic or other material resistant to heat and chemicals (FIG. 10).

The base 14 of the housing has an outlet 17, toward which the base 14 slopes at an angle of 5° to 15° from three surfaces of the interior 4 of the housing. A connecting nipple 18 is arranged in the outlet 17.

The rests 15 are arranged in such a way that the container 11 is always situated above the sloping base of the housing.

Arranged on the rear wall 19 of the housing is a biasing means comprising spring element 20 which biases against the back wall 21 of the container 11. When the cover 3 is open, this biasing means 20 tilts the container 11 toward the inside 22 of the front wall 12 of the housing, against which the container bears over lip 23 of one of its lateral surfaces, the container 11 pivoting along its forward lower edge.

Figure 1:
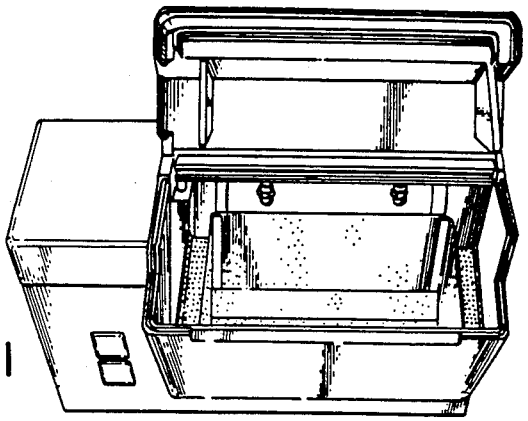
FIG. 1 is a perspective view of a device according to the invention, in which the top is open.
Figure 2:
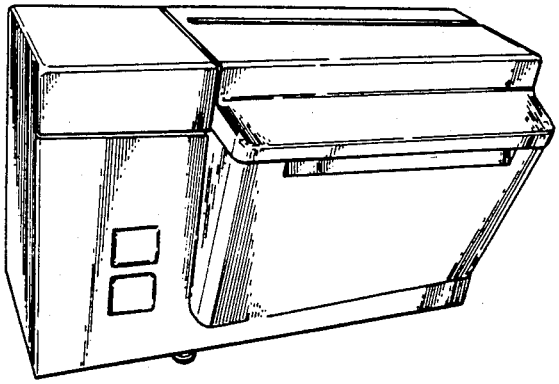
FIG. 2 is a perspective view thereof, showing the top closed.
Figure 3:
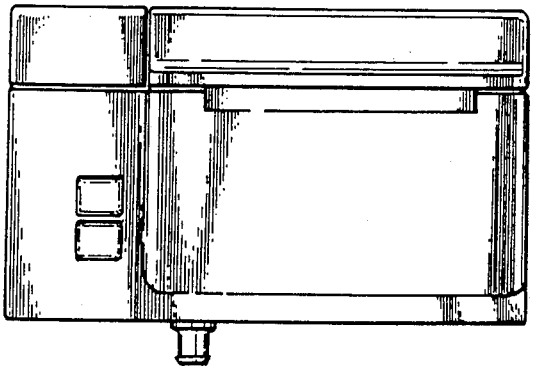
FIG. 3 is a front elevational view thereof.
Figure 4:
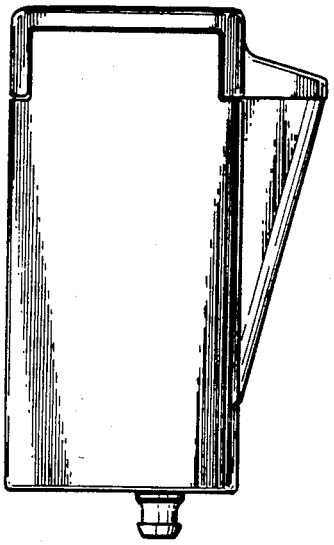
FIG. 4 is a left side elevational view thereof.
Figure 5:
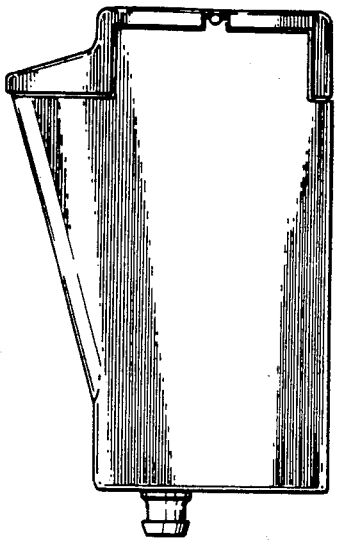
FIG. 5 is a right side elevational view thereof.
Figure 6:
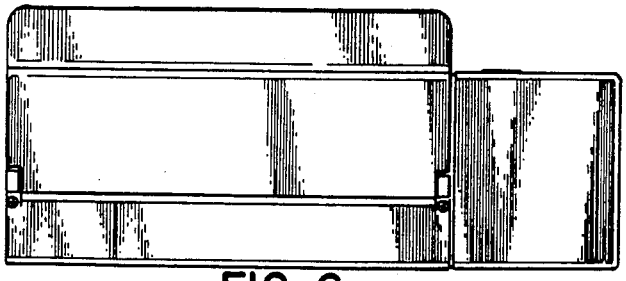
FIG. 6 is a top elevational view thereof, with the front of the device at the top of the figure.
Figure 7:
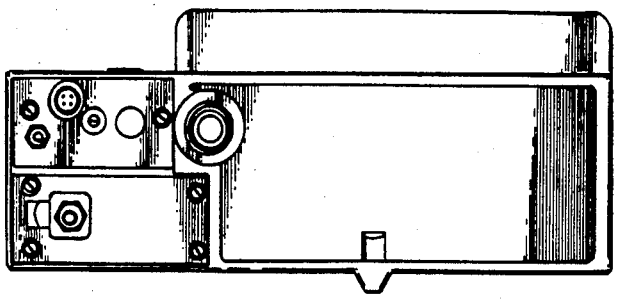
FIG. 7 is a bottom elevational view thereof.
Figure 8:
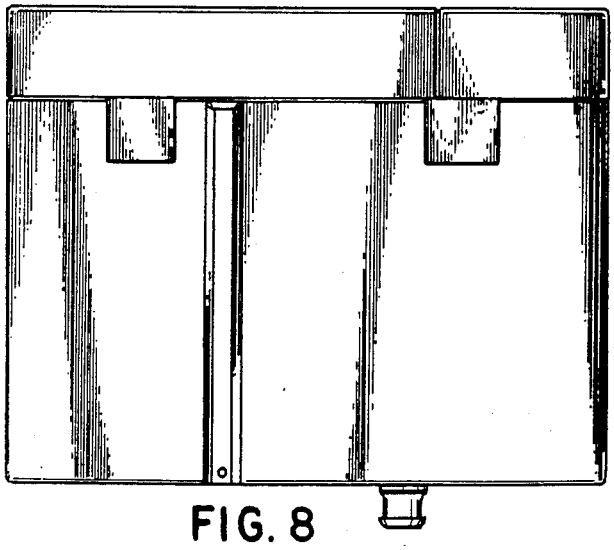
FIG. 8 is a back elevational view thereof.

Arranged on the hinged cover 3 are one or more narrow closure elements 24 of nose-like cross-section (FIGS. 1,3) which, when the cover 3 closes, engage container side flanges 25 of container 11 and press it from the filling position shown in FIG. 1 into its horizontal in-use position, overcoming the the force of biasing means 20 and keeping the container 11 in that position during preparation of the detergent solution and/or suspension. In the closed position of the cover, the closure elements 24 rest on the horizontal surfaces of the side flanges 25 over areas 26 of their edge surfaces 27 remote from the cover. During opening of the cover, the tips of the closure elements first frictionally slide along the surfaces of the side flanges 25 before they are lifted off by the pivoting movement of the cover. The frictional force generated counteracts and modifies the opening movement of the cover. It is for this reason that the elements in question are referred to as closure elements.

The side flanges 25 are also designed to serve as handles for the removal of container 11.

The portion of the front wall 12 of the housing adjacent the container 11 is inclined upwardly outward from the base 14 of the housing in relation to the vertical axis A of the housing, preferably at an angle Y of 15°.

The cover 3 has a lateral step 28 and the depth of the cover 3 from its hinges to its front end is preferably two thirds the total depth B of the device, while the height of the cover from the point where its edge engages the front wall 11 to its top surface when closed, is preferably one fifth the height H of the housing.

Above the container 11, at least one, preferably two or more injection nozzles 31 are arranged in the housing interior 4 in that region 29 of the upper wall 30 of the housing which is not formed by the cover 3. The longitudinal axis of each injection nozzle 31 is inclined toward and relative to the vertical axis A of the housing, preferably at an angle X of 8°. The openings of the injection nozzles 31 point toward the detergent material 13. The injection nozzles 31 are flat-jet nozzles for which representative spray is indicated by dash-dot lines in FIG. 10.

A liquid level governor 32 is arranged above the outlet opening 17, projecting into the interior 4 of the housing. The governor 32 is a substantially cylindrical body which has a lower opening 33 in the region of the base 14 of the housing and an upper opening 34 situated substantially level with the maximum filling level 35 of the detergent 13.

Formed in an edge region of the cover 3 is a control means, which is an element which projects into the compartment 5 and wihch cooperates with a device 37 to influence the water supply. In the example illustrated, the arrangement in question is the combination of a magnet 37 with a Hall-effect switch 36, that is, a magnetically activated switch that uses a Hall generator, trigger circuit, and transistor amplifier on a silicon chip. The switch 36 and the magnet 37 act on a magnetic valve 38 which is arranged in the compartment 5 and through which the supply of water to the device 1 is controlled.

For indicating certain operational states, the housing 2 is provided in its front wall in the region of the compartment 7 with two indicating lamps 39 optionally illuminated by bulbs or diodes 40 arranged in the control compartment 7.

For fixing to a wall or machine component with which it is to be associated, the device 1 comprises several fastening elements 41, some of which comprise movable bearings capable of compensating for any thermal expansion of the device 1.

The housing 2 and the cover 3 of the device may be made of a plastic material resistant to temperature and chemicals, preferably a polyurethane foam, or a metal such as stainless steel.

In the position shown in FIG. 1, the container 11 is filled with the powdered, granular or block-form detergent 13. The device 1 is then closed by lowering the cover 3, the closure elements 24 engaging the side flanges 25 and, while sliding along them, pressing the sieve-like container 11 into its horizontal inuse position on the base 14 of the housing and the rests 15. If, now, a suspension is to be prepared, the magnetic valve 38 opens the water supply so that water enters the device through inlet 42, passes to the injection nozzles (in a manner not shown) and is sprayed through the nozzles 31 onto the detergent 13. The position of the inlet 42 is not critical, since the water can enter the housing at almost any point, and then be directed to the spray means 31. The device may be supplied both with hot water at around 80° to 90° C. and with cold water. The detergent 13 dissolves or disintegrates in the water and, with it, forms the solution or suspension. The suspension is then fed through the outlet opening 17, for example to an institutional dishwashing machine. A conductivity measuring arrangement is preferably arranged in the region of the institutional dishwashing machine, measuring the conductivity of the wash liquor in the dishwashing machine. This conductivity measuring arrangement co-operates with the magnetic valve 38 and the printed circuit board 9 equipped with electronic components 8 in such a way that, when a preselected conductivity value is reached in the wash liquor of the dishwashing machine, the supply of water to the injection nozzles 31 is interrupted and, when another preselected conductivity value is reached, is resumed.

In the interior 4 of the housing, the suspension or solution flows along the base 14 of the housing to the lower opening 33 of the liquid level governor 32 and, in the event of an excessive water supply, through the upper opening 34 as well, so that the suspension is prevented from overflowing and issuing from the interior 4 of the housing.

To prevent water from issuing from the injection nozzles 31 when the cover 3 is open or partly open, the element 36 and the device 37 act in combination on the magnetic valve 38 in such a way that, even if the cover is not fully closed, the supply of water to the device 1 is interrupted.

The embodiment described in the foregoing may of course be modified in many ways without departing from the basic concept of the invention. For example, a transparent inspection window may be provided in the front wall 12 for observing the suspension in the interior 4 of the housing.

The closure elements may also be in the form of clips arranged on or projections formed integrally with the cover.

We claim:

1. A device for the preparation and dispensing of a detergent solution or dispersion comprising:

a vertical housing comprising a base, a front wall with a section which is upwardly inclined outward from the housing vertical axis, said housing further comprising an opening on its top forward surface that is about two thirds the depth of the top and is about as wide as said inclined section;

a hinged cover the configuration and size of, and capable of completely closing, said opening;

a water permeable, open topped, detergent container removeably disposed within said housing, adjacent said inclined section;

lateral biasing means within said housing for biasing against said container so that it pivots on a forward lower horizontal edge until a face of said container abuts the inner face of said inclined section;

closure means comprised within the inner face of said cover, for biasing against at least one horizontal surface of said container upon closing said cover, so that the force of said lateral biasing means is overcome and said container is pivoted back into a generally vertical attitude, and so held as long as said cover is closed;

inlet means for introducing water into said housing;

spray means located within said housing and operatively connected to said inlet means for spraying introduced water downward into the top of said container, so that said water will impact upon detergent placed within said container, and outlet means for dispensing water which has been introduced into said housing, and any detergent dissolved or suspended therein, located in said base.

2. The device of claim 1 wherein:

said at least one horizontal surface of the container comprises two flanges extending laterally from said container; and said closure means comprises two closure elements of substantially nose-like cross-section, projecting downward from said cover when it is closed, said closure elements being positioned within said cover so that when said cover is closed, each said closure element engages one said flange.

3. The device of claim 1 wherein:

said cover further comprises a step which is about one fifth the vertical height of a front wall of said housing.

4. The device of claim 2 wherein:

said cover further comprises a step which is about one fifth the vertical height of a front wall of said housing.

5. The device of claim 1 wherein:

said spray means comprise at least one injection nozzle pivotally mounted within said housing behind said housing opening downwardly inclined toward the front of said housing at an angle of about 5° to 10° relative to the housing vertical axis.

6. The device of claim 4 wherein:

said spray means comprise at least one injection nozzle pivotally mounted within said housing behind said housing opening downwardly inclined toward the front of said housing at an angle of about 5° to 10° relative to the housing vertical axis.

7. The device of claim 1 wherein:

a liquid level governor is mounted within said housing on top of said outlet, comprising a lower opening at the base of said housing and an upper opening above it, substantially, at the desired maximum filling level of detergent to be placed in said container.

8. The device of claim 6 wherein:

a liquid level governor is mounted within said housing on top of said outlet, comprising a lower opening at the base of said housing and an upper opening above it, substantially, at the desired maximum filling level of detergent to be placed in said container.

9. The device of claim 1 wherein:

that portion of said housing in which said container is disposed forms a separate compartment including said spray means and access to said outlet means; and said base under said container is sloped toward said outlet means access sufficiently to afford substantial drainage of introduced water and formed detergent solution or suspension.

10. The device of claim 8 wherein:

that portion of said housing in which said container is disposed forms a separate compartment including said spray means and access to said outlet means; and said base under said container is sloped toward said outlet means access sufficiently to afford substantial drainage of introduced water and formed detergent solution or suspension.

11. The device of claim 1 wherein:

said water permeable container has sieve-like sides and bottom comprising a mesh with widths of about 0.25 mm or round holes of about 0.6 to 0.88 mm in diameter.

12. The device of claim 10 wherein:

said water permeable container has sieve-like sides and bottom comprising a mesh with widths of about 0.25 mm or round holes of about 0.6 to 0.88 mm in diameter.

13. The device of claim 1 wherein:

communication means are disposed within said housing, for communicating when said cover is closed to a water shut-off device, also disposed within said housing, in operative connection with said inlet means, so that water cannot enter said housing when said cover is opened.

14. The device of claim 12 wherein:

communication means are disposed within said housing, for communicating when said cover is closed to a water shut-off device, also disposed within said housing, in operative connection with said inlet means, so that water cannot enter said housing when said cover is opened.

15. The device of claim 13 wherein:

said communication means comprise a magnet and Hall-effect switch, arranged on the housing at the edge of the cover opening and which projects into the interior of the housing.

16. The device of claim 14 wherein:

said communication means comprise a magnet and Hall-effect switch, arranged on the housing at the edge of the cover opening and which projects into the interior of the housing.

17. The device of claim 1 wherein:

measuring means are disposed within said housing, for measuring the electrical conductivity of a detergent solution or suspension formed within said device;

computer means are operatively connected to said measuring means, for determining the amount of water to be introduced into said housing to achieve a given detergent solution or suspension concentration, as measured by said electrical conductivity; and flow rate means are disposed within said housing operatively connected to said inlet means and controlled by said computer means, for adjusting the amount of water introduced into said housing to achieve said desired concentration.

18. The device of claim 14 wherein:

measuring means are disposed within said housing, for measuring the electrical conductivity of a detergent solution or suspension formed within said device;

computer means are operatively connected to said measuring means, for determining the amount of water to be introduced into said housing to achieve a given detergent solution or suspension concentration, as measured by said electrical conductivity; and flow rate means are disposed within said housing operatively connected to said inlet means and controlled by said computer means, for adjusting the amount of water introduced into said housing to achieve said desired concentration.

19. The device of claim 16 wherein:

measuring means are disposed within said housing, for measuring the electrical conductivity of a detergent solution or suspension formed within said device;

computer means are operatively connected to said measuring means, for determining the amount of water to be introduced into said housing to achieve a given detergent solution or suspension concentration, as measured by said electrical conductivity; and flow rate means are disposed within said housing operatively connected to said inlet means and controlled by said computer means, for adjusting the amount of water introduced into said housing to achieve said desired concentration.

20. The device of claim 19 wherein:

said lateral biasing means comprise a spring-like element fixed at one end to said housing and slideably biasing against said container at another end;

said front wall is inclined at an angle of about 10° to 20°; and said base slopes toward said outlet at an angle of about 5° to 15°.

* * * * *